US010260344B2

(12) United States Patent
Van Doesburg et al.

(10) Patent No.: US 10,260,344 B2
(45) Date of Patent: Apr. 16, 2019

(54) TAILING DEPOSIT TOOL

(71) Applicant: IHC HOLLAND IE B.V., Sliedrecht (NL)

(72) Inventors: Johannes Bartholomeus Van Doesburg, Dordrecht (NL); Pieter Abraham Lucieer, Rotterdam (NL)

(73) Assignee: IHC Holland IE B.V., Sliedrecht (NL)

( * ) Notice: Subject to any disclaimer, the term of this patent is extended or adjusted under 35 U.S.C. 154(b) by 199 days.

(21) Appl. No.: 14/904,633

(22) PCT Filed: Jul. 10, 2014

(86) PCT No.: PCT/NL2014/050468

§ 371 (c)(1),
(2) Date: Jan. 12, 2016

(87) PCT Pub. No.: WO2015/005785

PCT Pub. Date: Jan. 15, 2015

(65) Prior Publication Data

US 2016/0168992 A1 Jun. 16, 2016

(30) Foreign Application Priority Data

Jul. 12, 2013 (NL) ..... 2011157

(51) Int. Cl.
*E21C 49/02* (2006.01)
*E02F 7/00* (2006.01)
(Continued)

(52) U.S. Cl.
CPC ..... *E21C 49/02* (2013.01); *E02F 3/8858* (2013.01); *E02F 3/8875* (2013.01); *E02F 3/905* (2013.01);
(Continued)

(58) Field of Classification Search
CPC ..... E21C 49/02; E21C 50/00; E02F 3/8858; E02F 3/8868; E02F 3/8875; E02F 3/905;
(Continued)

(56) References Cited

U.S. PATENT DOCUMENTS 4,070,061 A * 1/1978 Obolensky ..... E02F 3/92 299/8
4,208,813 A 6/1980 Latimer
(Continued)

FOREIGN PATENT DOCUMENTS

GB 2 495 287 A 4/2013
JP S5681738 A2 4/1981
(Continued)

OTHER PUBLICATIONS

"ABC Catalyst S12E16 Deep Sea Mining," Jun. 12, 2011, retrieved from the Internet: URL:https://www.youtube.com/watch?v=Zjb533re6zs.

(Continued)

*Primary Examiner* — Jamie L McGowan
(74) *Attorney, Agent, or Firm* — N.V. Nederlandsch Octrooibureau; Catherine A. Shultz

(57) ABSTRACT

A deep sea mining method includes providing a deep sea mining system for mining matter from a bottom of a body of water, the mining system including: a slurry line coupled with a pump system to transport the slurry from the bottom of the body of water; and a return line in fluid communication with the slurry line and distinguishable from the slurry riser, for transporting non valuable slurry part to the bottom of the body of water, the return line having a return line outlet proximate the bottom. The deep sea mining method further includes spreading the non valuable slurry part over the bottom of the body of water in a controlled manner.

8 Claims, 4 Drawing Sheets

(51) Int. Cl.

| | |
|---|---|
| ***E02F 7/06*** | (2006.01) |
| ***E21B 43/36*** | (2006.01) |
| ***E21C 50/00*** | (2006.01) |
| ***E02F 3/88*** | (2006.01) |
| ***E02F 3/90*** | (2006.01) |
| *E21B 43/01* | (2006.01) |

(52) U.S. Cl.
CPC ..... *E02F 7/00* (2013.01); *E02F 7/005* (2013.01); *E02F 7/065* (2013.01); *E21B 43/36* (2013.01); *E21C 50/00* (2013.01); *E21B 2043/0115* (2013.01)

(58) Field of Classification Search
CPC ..... E02F 3/94; E02F 5/24; E02F 7/00; E02F 7/005; E02F 7/065; E21B 43/36; E21B 2043/0115
See application file for complete search history.

(56) References Cited

U.S. PATENT DOCUMENTS 4,391,468 A * 7/1983 Funk ..... E02F 3/90 299/8
4,685,742 A * 8/1987 Moreau ..... E02F 3/8858 299/8
4,750,279 A * 6/1988 Hofland ..... E02F 3/8858 37/313
4,896,445 A 1/1990 Deal
6,145,223 A * 11/2000 Flesen ..... E02F 3/8808 299/8
6,877,565 B2 * 4/2005 Edvardsen ..... E21B 21/001 166/352
6,966,132 B1 * 11/2005 Jacobsen ..... B63C 11/52 15/409
7,765,725 B2 * 8/2010 Jacobsen ..... E02F 3/8858 175/209
8,091,255 B2 * 1/2012 Drabble ..... E02F 3/8841 37/307
8,678,514 B2 * 3/2014 Efthymiou ..... E02F 3/8866 299/8
9,062,434 B2 * 6/2015 Espinasse ..... E02F 3/902
2009/0284068 A1 11/2009 Yu et al.
2012/0234552 A1 9/2012 Vaughan
2016/0289917 A1 * 10/2016 Sakamoto ..... E21C 50/00

FOREIGN PATENT DOCUMENTS

JP H0571237 A 3/1993
WO 2010/000289 A1 1/2010
WO 2010/092145 A1 8/2010
WO 2011/072963 A1 6/2011

OTHER PUBLICATIONS

International Search Report dated Mar. 5, 2015, in corresponding PCT application.
Mastbergen et al.; "Controlled submerged deposition of fine grained dredged sediment with various diffuser types", WODCON XVII 2004, Hamburg, Germany pp. 1-10.

* cited by examiner

TAILING DEPOSIT TOOL

BACKGROUND

The present invention relates to a deep sea mining method comprising, providing a deep sea mining system for mining matter from a bottom of a body of water.

GB2495287 relates to a riser system for transporting a slurry from a position adjacent to the seabed to a position adjacent to the sea surface. In order to be flexible in production, GB2495287 teaches to provide first and second risers; a slurry pump system to transport slurry up one of the risers; and a waste water pump system to return waste water down one of the risers. The slurry pump system and the waste water pump system are selectively connectable to each of the risers to allow each riser to be either a slurry riser or a waste water riser.

WO 2010/092145 A1 is another example having a riser conduit and a tailings stream. Tailings are just disposed via a disposal pipe, see FIG. 3. During operations, tailings will accumulate and may easily cause problems in that a site of interest is covered.

US2012/234552 A1 relates to a system for harvesting natural gas from a clathrate deposit. A pipe or tube is suggested for distributing the water back into the ocean away from the harvesting location. In addition, it is also suggested to pump the debris through a particulate disposal system for returning the debris to the sea floor at a location that is removed from the clathrate deposit. Still over time, debris will accumulate and may easily cause problems.

WO 2011/072963 A1 relates to a method of converting a methane containing hydrate deposit in the water bottom into a marketable product. FIG. 2 shows a tailing disposal pipe to a site. Again, over time, debris will accumulate and may easily cause problems.

US2009/284068 A1 relates to a method of monitoring and adjusting a flow rate of a slurry in a riser system of a deep sea mining system. It is suggested to discharge waste water at the sea floor level.

In conclusion, where the prior art disposes debris rather than water alone, it is disposed at a fixed location such that over time, debris will accumulate and may easily cause problems.

SUMMARY OF THE INVENTION

The invention aims to provide a more efficient deep sea mining method. Another object of the invention is to improve a known deep sea mining method in that a problem associated therewith is at least partly solved.

Yet another object of the invention is to provide an alternative deep sea mining method.

According to a first aspect of the invention this is realized with a deep sea mining method comprising providing a deep sea mining system for mining matter from a bottom of a body of water, the mining system comprising;

- a slurry line coupled with a pump system to transport said slurry from the bottom of the body of water, and
- a return line in fluid communication with the slurry line and distinguishable from the slurry line, for transporting a non valuable slurry part to the bottom of the body of water, the return line having a return line outlet proximate said bottom, the deep sea mining method further comprising spreading the non valuable slurry part over the bottom of the body of water in a controlled manner.

The spreading of the non valuable slurry part over the bottom of the body of water in a controlled manner enables to perform the mining method more efficient in that non valuable slurry part is distributed in a controlled manner which includes that non valuable slurry part does not cover slurry still to be excavated from the bottom of a body of water. The controlled manner assures that non valuable slurry part is distributed over the bottom of a body of water in a predictable manner.

In an embodiment of the mining method, the mining system comprises a unit for processing mined matter, wherein the return line is in fluid communication with the slurry line through the processing unit. Such a processing unit may take the form of a floating object like a vessel, a subsea platform, or a supported platform.

In an embodiment of the mining method, the spreading of the non valuable slurry part over the bottom of the body of water comprises moving the return outlet over the bottom of the body of water, also seafloor, preferably in a desired pattern. The moving of the return outlet over the seafloor intends to distribute the non valuable slurry part over the bottom of a body of water. The moving of the return outlet over the seafloor is preferably predictable e.g. along a desired pattern, however it may involve intended movement caused by sea currents which has an unpredictable component. It will be clear that, in case of the movement caused by sea currents, despite the non predictable movement of the return outlet, over time the non valuable slurry part is distributed in an even manner.

The matter may comprise gashydrates.

According to a further aspect of the invention this is realized with a deep sea mining system for mining matter from a bottom of a body of water, wherein the system comprises,

- a slurry line coupled with a pump system to transport said slurry from the bottom of the body of water,
- a return line, in fluid communication with the slurry line and distinguishable from the slurry line, for transporting a non valuable slurry part to the bottom of the body of water and having a return line outlet proximate the seafloor, and
- a spreading device coupled with the return line outlet for spreading the non valuable slurry part over the bottom of the body of water in a controlled manner.

The spreading device spreads the non valuable slurry part over the bottom of the body of water in a controlled manner and thus enables to mine more efficient in that non valuable slurry part is distributed in controlled manner which includes that non valuable slurry part does not cover slurry still to be excavated from the bottom of a body of water.

In an embodiment, the mining system comprises a unit for processing mined matter, wherein the return line is in fluid communication with the slurry line through the processing unit. The processing unit may subject the slurry to any desired process like segregate the slurry into a desired part and a non valuable slurry part.

In an embodiment of the deep sea mining system, the spreading device comprises a boom member and wherein the return line outlet is coupled with the spreading device through said boom member for moving the outlet relative to the bottom of the body of water.

In an embodiment of the deep sea mining system, the spreading device comprises a vehicle for moving over the bottom of the body of water and coupled with the return line outlet for moving the return outlet over the bottom of the body of water in a desired pattern. The moving of the return outlet over the seafloor intends to distribute the non valuable slurry part over the bottom of a body of water. The moving of the return outlet over the seafloor is predictable.

In an embodiment of the deep sea mining system, the vehicle is remotely controllable. The vehicle is therefore provided with control means to control the vehicle in a manner known per se.

The various aspects discussed in this patent can be combined in order to provide additional advantageous advantages.

DESCRIPTION OF THE DRAWINGS

The invention will be further elucidated referring to preferred embodiments shown in the schematic drawings wherein shown in.

DETAILED DESCRIPTION OF EMBODIMENTS

Figure 1:
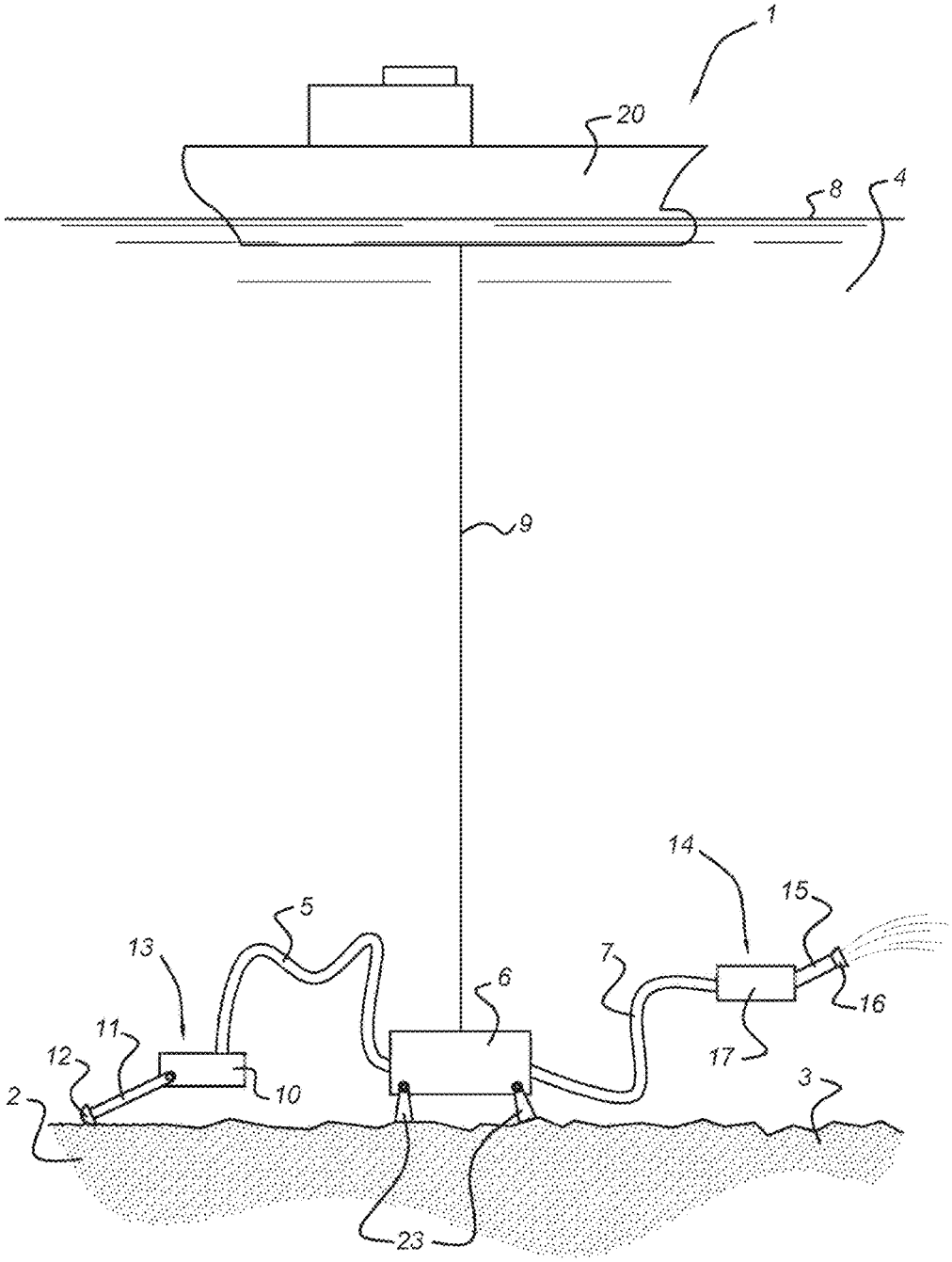
FIG. 1 in side view a mining system according to the invention.

In FIG. 1 a deep sea mining system 1 is shown. The system 1 is suitable for mining matter 2 from a bottom 3 of a body of water 4, typically a seafloor at a depth of between 200 and 3000 meters, more specifically between 400 and 2000 meters.

The deep sea mining system 1 comprises a slurry line 5 for transporting slurry. The slurry contains seawater and excavated matter which is separated from the bottom 3 by an excavation device 13 known per se. The shown excavation device 13 has a cutter arm 11 which arm is provided with a cutting head 12. Here, the cutter arm 11 is hingeably coupled with an excavation device body 10. The slurry line is coupled with a pump system 6 to transport said slurry from the bottom of the body of water.

The deep sea mining system 1 comprises a return line 7. The return line 7 is suitable for transporting slurry, in particular suitable for transporting a non valuable slurry part to the bottom 3 of the body of water 4. The return line 7 is in fluid communication with the slurry line 5. The return line 7 is distinguishable from the slurry line. The return line 7 has a return line outlet 16 as shown proximate to the seafloor 3.

The deep sea mining system 1 comprises a spreading device 14 coupled with the return line outlet 16 for spreading the non valuable slurry part over the bottom 3 of the body of water 4 in a controlled manner. The spreading device 14 here comprising a boom member 15. The return line outlet 16 is coupled with the spreading device 14 through said boom member 15 for moving the outlet 16 relative to the bottom 3 of the body of water 4. The spreading device 14 may take the form of e.g. a crawler having a boom, a Remotely operated vehicle (ROV), which spreads the non valuable slurry part in a pre determined path, or dot pattern.

The pump system 6 is coupled with a vessel 20 via a coupling line 9 for supplying the pump system 6 the required energy and controls. Here, the pump system 6 is supported by a pair of support members 23 which members are placed on the bottom 3 of the body of water 4.

The other embodiments of FIG. 2-4 will be described at least in so far they differ with the embodiment shown in FIG. 1.

Figure 2:
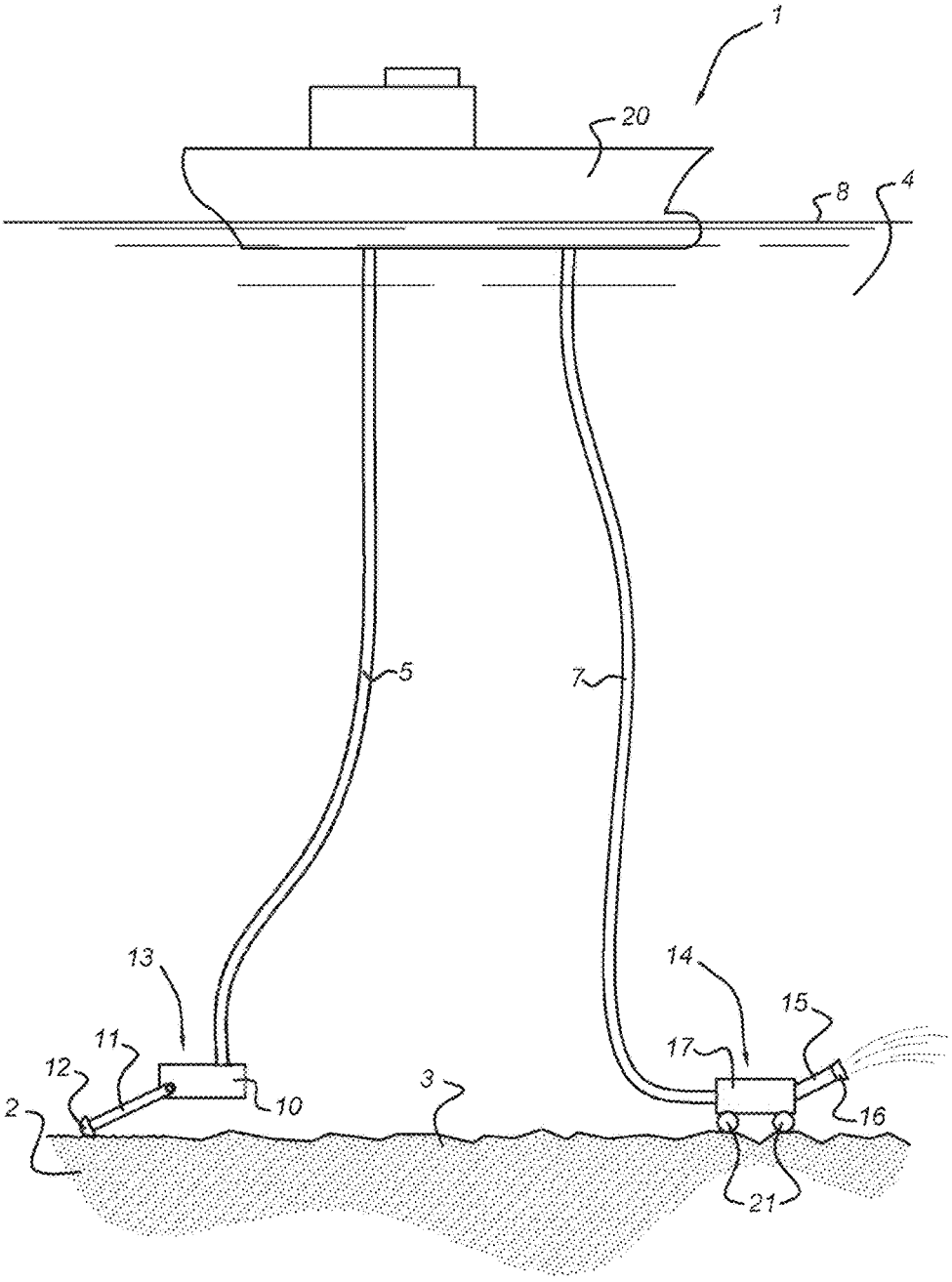
FIG. 2 in side view a further mining system according to the invention.

In FIG. 2, the deep sea mining system 1 comprises a slurry line 5 for transporting slurry. The slurry line 5 is coupled with the vessel 20. The deep sea mining system 1 comprises a return line 7. The return line 7 is coupled with the vessel 20 as well such that the slurry is transported up to proximate the water surface 8. The return line 7 is in fluid communication with the slurry line 5 via the vessel 20. The mining system 1 comprises a unit (not shown) for processing mined matter, wherein the return line is in fluid communication with the slurry line through the processing unit. Here, the unit is place on the vessel 20.

Here, the spreading device is a vehicle for moving over the seafloor while coupled with the return line outlet 16 for moving the return outlet over the bottom 3 of the body of water 4 in a desired pattern. The spreading device 14 is therefore provided with rolling members 21 suitable for a seafloor.

Figure 3:
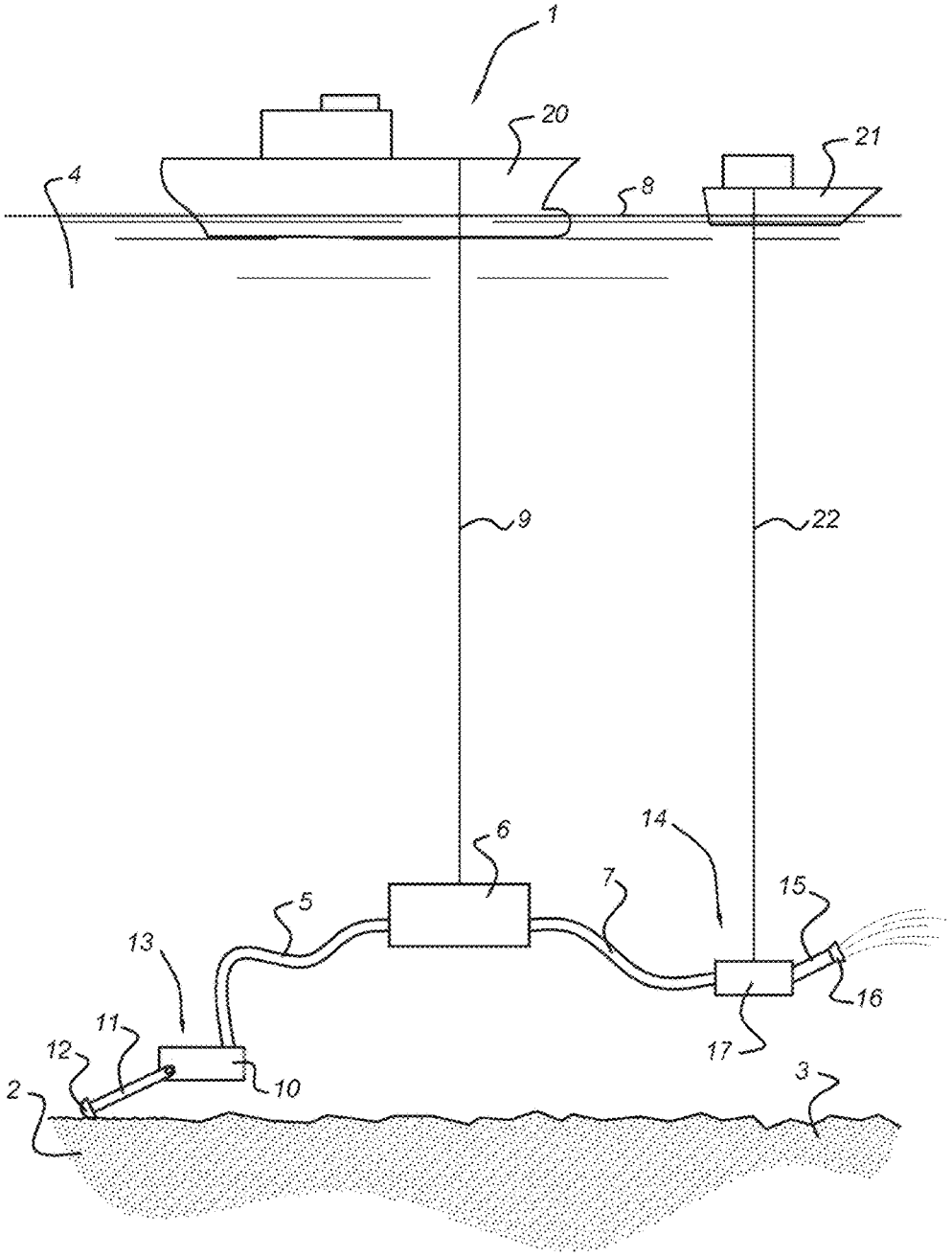
FIG. 3 in side view an even further mining system according to the invention, and FIG. 4 in side view of another mining system according to the invention.

In FIG. 3 the pump system 6 is a floating system which is able to float in a manner known per se and is kept in place via the coupling line 9 coupled with the vessel 20 at its upper end. Optionally, the spreading device body 17 may be suspended from an auxiliary vessel 21 by a suitable suspension means 22 like a cable.

Figure 4:
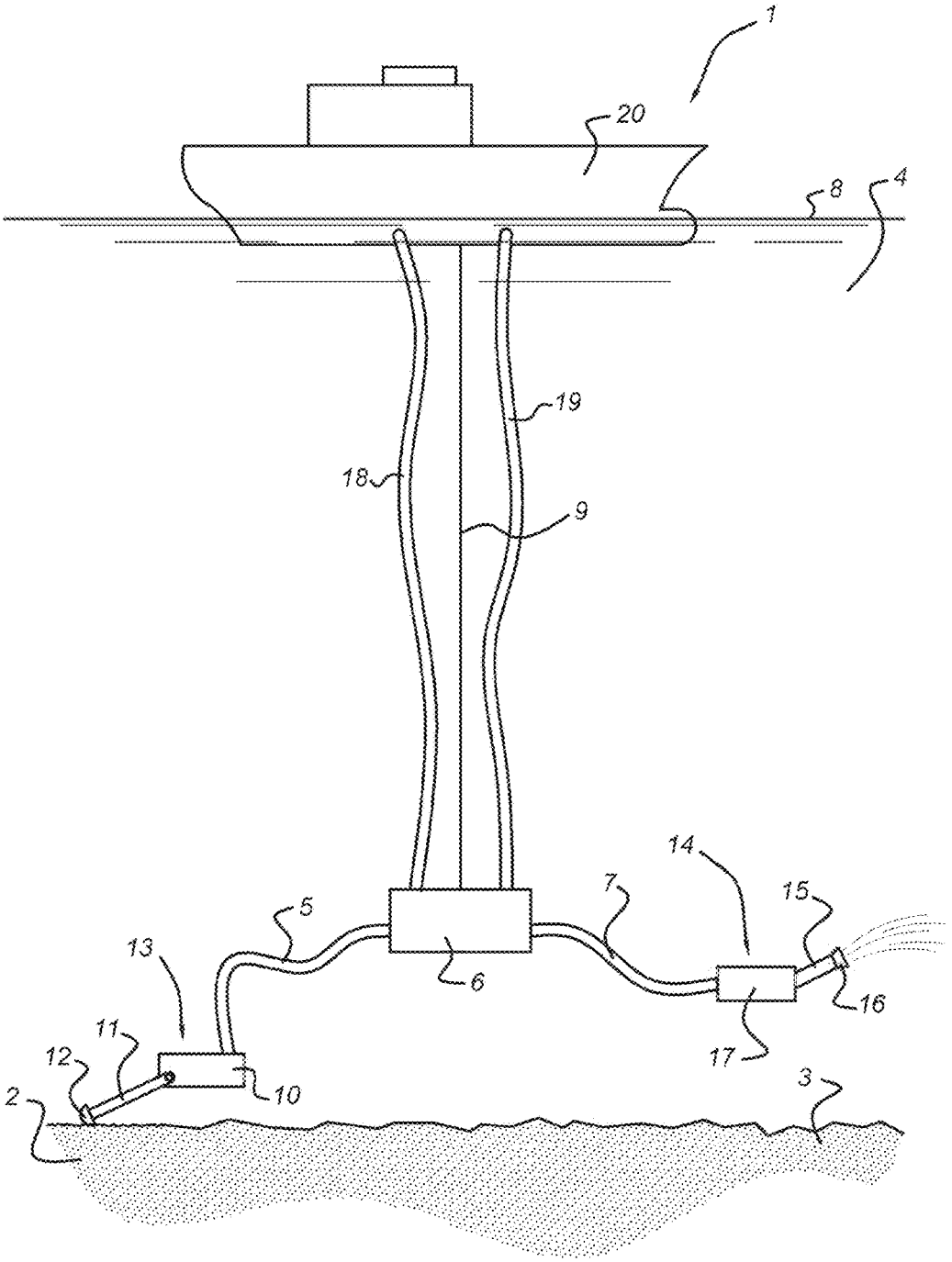

In FIG. 4 the slurry line 5 is coupled with the vessel 20. The return line 19 is coupled with the vessel 20 as well. The return line 7 is in fluid communication with the slurry line 18 via the vessel 20. The mining system 1 comprises a unit (not shown) for processing mined matter, wherein the return line is in fluid communication with the slurry line through the processing unit. Here, the unit is place on the vessel 20.

The pump system 6 is a floating system which is able to float in a manner known per se and is kept in place via the coupling line 9 coupled with the vessel 20 at its upper end.

Here, the spreading device is floating for moving over the seafloor while coupled with the return line outlet 16 for moving the return outlet over the bottom 3 of the body of water 4 in a desired pattern. The spreading device 14 is therefore provided with rolling members 21 suitable for a seafloor.

In use of the shown mining systems 1 of FIG. 1-4, a non valuable slurry part is spread over the bottom 3 of the body of water in a controlled manner. This is beneficial since it enables to uncover or win useful sediments while covering of these is prevented.

Preferably, the mined matter is processed. This processing may take place on board of the vessel 20 or elsewhere in the body of water 4, like on the bottom 3 of the body of water 4.

It will also be obvious that the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. Deep sea mining method comprising, providing a deep sea mining system for mining matter from a bottom of a body of water, the mining system comprising, a slurry line coupled with a pump system to transport said slurry from the bottom of the body of water, a return line in fluid communication with the slurry line and distinguishable from the slurry line, for transporting a non valuable slurry part to the bottom of the body of water, the return line having a return line outlet proximate said bottom, a spreading device coupled with the return line outlet, the spreading device comprising a boom member wherein the return line outlet is coupled with the spreading device through said boom member for moving the outlet relative to the bottom of the body of water, and the deep sea mining method further comprising spreading the non valuable slurry part over the bottom of the body of water in a controlled manner by moving the return line outlet over the bottom of the body of water.

2. Deep sea mining method according to claim 1, the mining system comprising a unit for processing mined matter, wherein the return line is in fluid communication with the slurry line through the processing unit.

3. Deep sea mining method according to claim 1, wherein spreading the non valuable slurry part over the bottom of the body of water comprises moving the return outlet over the bottom of the body of water in a desired pattern.

4. Deep sea mining method according to claim 1, wherein the matter comprises gashydrates.

5. Deep sea mining system according to claim 4, comprising a unit for processing mined matter, wherein the return line is in fluid communication with the slurry line through the processing unit.

6. Deep sea mining system for mining matter from a bottom of a body of water, the system comprising, a slurry line coupled with a pump system to transport said slurry from the bottom of the body of water, a return line, in fluid communication with the slurry line and distinguishable from the slurry line, for transporting a non valuable slurry part to the bottom of the body of water and having a return line outlet proximate said bottom, and a spreading device coupled with the return line outlet for spreading the non valuable slurry part over the bottom of the body of water in a controlled manner by moving the return line outlet over the bottom of the body of water, the spreading device comprising a boom member wherein the return line outlet is coupled with the spreading device through said boom member for moving the return line outlet relative to the bottom of the body of water.

7. Deep sea mining system according to claim 6, the spreading device comprising a vehicle for moving over the bottom of the body of water coupled with the return line outlet for moving the return outlet over the bottom of the body of water in a desired pattern.

8. Deep sea mining system according to claim 7, wherein the vehicle is remotely controllable.

* * * * *